US010056714B2

(12) United States Patent
Sato

(10) Patent No.: US 10,056,714 B2
(45) Date of Patent: Aug. 21, 2018

(54) CONNECTOR DEVICE INCLUDING COMING-OFF PREVENTING STRUCTURE

(71) Applicant: HIROSE ELECTRIC CO., LTD., Tokyo (JP)

(72) Inventor: Hayato Sato, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/823,907

(22) Filed: Nov. 28, 2017

(65) Prior Publication Data

US 2018/0159270 A1 Jun. 7, 2018

(51) Int. Cl.

| | |
|---|---|
| ***H01R 9/24*** | (2006.01) |
| ***H01R 13/629*** | (2006.01) |
| ***H01R 12/71*** | (2011.01) |
| ***H01R 12/70*** | (2011.01) |
| ***H01R 12/55*** | (2011.01) |
| *H01R 13/64* | (2006.01) |

(52) U.S. Cl.

CPC ..... *H01R 13/62911* (2013.01); *H01R 12/55* (2013.01); *H01R 12/7005* (2013.01); *H01R 12/712* (2013.01); *H01R 13/64* (2013.01)

(58) Field of Classification Search

CPC ..... H01R 13/62911; H01R 13/46; H01R 13/6206; H01R 12/716; H01R 12/55; H01R 12/7005; H01R 12/712; H01R 13/64

See application file for complete search history.

(56) References Cited

U.S. PATENT DOCUMENTS

2010/0055984 A1* 3/2010 Tsuchida ..... H01R 12/716 439/626
2015/0244105 A1* 8/2015 Peng ..... H01R 13/6205 439/39
2015/0288110 A1* 10/2015 Taniguchi ..... H01R 13/46 439/620.22
2017/0340190 A1* 11/2017 Niwa ..... A61B 1/00124

* cited by examiner

*Primary Examiner* — Jean F Duverne
(74) *Attorney, Agent, or Firm* — Rankin, Hill & Clark LLP

(57) ABSTRACT

The present invention provides a connector device having a structure in which a protruding or a recessed fitting portion is provided at a surface of a columnar terminal of a cable-side connector (first connector) and a recessed or a protruding fit portion is provided at a fixed contact piece of a U-shaped terminal of a substrate-side connector (second connector). In the connector device, when the connectors are connected to each other, the fitting portion that is provided at the surface of the terminal of the cable-side connector is fitted to the fit portion that is provided at the fixed contact piece of the terminal of the substrate-side connector, so that a force that prevents the connectors from coming off from each other (coming-off force) is increased.

13 Claims, 9 Drawing Sheets

CONNECTOR DEVICE INCLUDING COMING-OFF PREVENTING STRUCTURE

BACKGROUND OF THE INVENTION

1. Field of the Invention

The present invention relates to a connector device including a substrate-side connector and a cable-side connector for connection between substrates. More specifically, the present invention relates to a coming-off preventing structure of the substrate-side connector and the cable-side connector.

2. Description of the Related Art

An existing connector device for connection between substrates includes a substrate-side connector that is provided on a substrate and a cable-side connector that is fitted to the substrate-side connector. When the cable-side connector is inserted into the substrate-side connector, a plurality of columnar (rod-shaped) terminals that are held in a housing of the cable-side connector are fitted to and electrically connected to a plurality of U-shaped (fork-shaped) terminals that are held in a housing of the substrate-side connector.

For example, in a connector device that is described in Japanese Unexamined Patent Application Publication No. 9-320693 and that includes a female connector, which is a substrate-side connector, and a male connector, which is a cable-side connector, upper and lower surfaces of rod-shaped male contacts of the male connector are interposed between and elastically contact protruding contact portions (contact beams) provided on upper and lower portions of U-shaped female contacts of the female connector. As a result, they are electrically connected to each other.

As in the above-described existing example, in the connector device for connection between substrates, protruding contacts of the terminals of the substrate-side connector elastically contact surfaces of the terminals of the cable-side connector to maintain a fitted state. Therefore, when a force that is produced by, for example, vibration is exerted upon, for example, the substrate-side connector, the cable-side connector, and cables, the fitted state may be released and the connectors may come off from each other. For example, in an internal substrate of a servo mechanism used in a machine tool, a robot arm, or the like, since a force that is produced by, for example, vibration or a fast and slow motion is frequently exerted upon, for example, the substrate-side connector, the cable-side connector, and the cables, an elastic force that maintains the fitted state between the terminals of the substrate-side connector and the terminals of the cable-side connector is weakened, as a result of which in the end the terminals are brought out of contact with each other.

SUMMARY OF THE INVENTION

Accordingly, the present invention provides a connector device having a structure in which a protruding or a recessed fitting portion is provided at a surface of a columnar terminal of a cable-side connector (first connector) and a recessed or a protruding fit portion is provided at a fixed contact piece of a U-shaped terminal of a substrate-side connector (second connector). In the connector device, when the connectors are connected to each other, the fitting portion that is provided at the surface of the terminal of the cable-side connector is fitted to the fit portion that is provided at the fixed contact piece of the terminal of the substrate-side connector, so that a force that prevents the connectors from coming off from each other (coming-off force) is increased.

A connector device according to an embodiment of the present invention includes a first connector that includes at least a plug terminal and a plug housing that supports the plug terminal, the first connector being connected to a cable; and a second connector that includes at least a receptacle terminal and a receptacle housing that supports the receptacle terminal, the second connector being mounted on a substrate. The plug terminal includes a contact surface on one side and a fitting portion on another side. The receptacle terminal includes an elastic contact piece on one side and a fixed contact piece on another side, the elastic contact piece including a contact point portion, the fixed contact piece including a fit portion. When the first connector and the second connector are connected to each other, a part of the plug terminal is disposed between the elastic contact piece and the fixed contact piece of the receptacle terminal and an elastic force that is produced by the elastic contact piece of the receptacle terminal causes the contact surface of the plug terminal to be pushed by the contact point portion of the receptacle terminal. The fitting portion of the plug terminal is formed so as to be fitted to the fit portion of the receptacle terminal.

In a preferred embodiment of the connector device according to the present invention, the fixed contact piece is formed so as to contact an inner wall of the receptacle housing and so as not to spread outward.

In a preferred embodiment of the connector device according to the present invention, the plug housing includes a fitting protruding portion where the contact surface of the plug terminal is exposed from the one side and where the fitting portion of the plug terminal is exposed from the other side; the receptacle housing includes a fitting recessed portion that is formed so as to receive and so as to be fitted to the fitting protruding portion; and at least a part of the elastic contact piece of the receptacle terminal is exposed from one of inner walls of the fitting recessed portion and at least a part of the fixed contact piece is exposed from another of the inner walls opposing the one of the inner walls.

In a preferred embodiment of the connector device according to the present invention, the number of the plug terminals of the plug housing is two or more; at least one of the two or more plug terminals includes the fitting portion; the number of the receptacle terminals of the receptacle housing is equal to the number of the plug terminals; and the receptacle terminal that is connected to the plug terminal including the fitting portion includes the fit portion.

In a preferred embodiment of the connector device according to the present invention, the fitting portion has a form of a recess, and the fit portion has a form of a protrusion.

In a preferred embodiment of the connector device according to the present invention, the fitting portion has a form of a protrusion, and the fit portion has a form of a recess.

In a preferred embodiment of the connector device according to the present invention, the plug housing includes four of the plug terminals and the receptacle housing includes four of the receptacle terminals, and all of the plug terminals each include the fitting portion and all of the receptacle terminals each include the fit portion.

In a preferred embodiment of the connector device according to the present invention, the plug housing includes a plug engaging portion at the fitting protruding portion, the receptacle housing includes a receptacle engaging portion at an inner wall of the fitting recessed portion, and the plug engaging portion is formed so as to engage with the receptacle engaging portion when the fitting protruding portion is inserted into the fitting recessed portion.

In a preferred embodiment of the connector device according to the present invention, a plurality of the plug engaging portions are each provided at a corresponding one of two side portions with a portion where the contact surface and the fitting portion of the plug terminal are exposed from the fitting protruding portion interposed therebetween; and a plurality of the receptacle engaging portions are each provided at a corresponding one of opposing inner walls with an inner wall where the elastic contact piece of the receptacle terminal is exposed from the fitting recessed portion and an inner wall where the fixed contact piece of the receptacle terminal is exposed from the engaging recessed portion interposed therebetween.

In a preferred embodiment of the connector device according to the present invention, the receptacle terminal includes in a U-shape the elastic contact piece and the fixed contact piece with a base portion interposed therebetween, and the elastic contact piece is situated on an upper side that is a far side from the substrate, and the fixed contact piece is situated on a lower side that is a near side from the substrate.

In a preferred embodiment of the connector device according to the present invention, the receptacle terminal includes in a U shape the elastic contact piece and the fixed contact piece with a base portion interposed therebetween, and the elastic contact piece is situated on a lower side that is a near side from the substrate, and the fixed contact piece is situated on an upper side that is a far side from the substrate.

In a preferred embodiment of the connector device according to the present invention, the second connector is mounted on the substrate with a fitting direction in which the second connector is fitted to the first connector being perpendicular to the substrate.

A contact surface is provided on one side of the plug terminal of the cable-side connector (first connector), a fitting portion is provided on another side of the plug terminal of the cable-side connector, a contact point portion is provided at the elastic contact piece on one side of the receptacle terminal of the substrate-side connector (second connector), and a fit portion is provided at the fixed contact piece on another side of the receptacle terminal of the substrate-side connector. Therefore, when the connectors are connected to each other, an elastic force that is produced by the elastic contact piece of the receptacle terminal causes the contact point portion of the elastic contact piece to push the contact surface of the plug terminal, and the fitting portion of the plug terminal to be firmly fitted to the fit portion of the fixed contact piece of the receptacle terminal. Therefore, even if a force that is produced by, for example, vibration is exerted upon, for example, the substrate-side connector, the cable-side connector, and the cable, it is possible to maintain the fitted state between the connectors and to prevent the connectors from coming off from each other.

DESCRIPTION OF THE PREFERRED EMBODIMENTS

Figure 1:
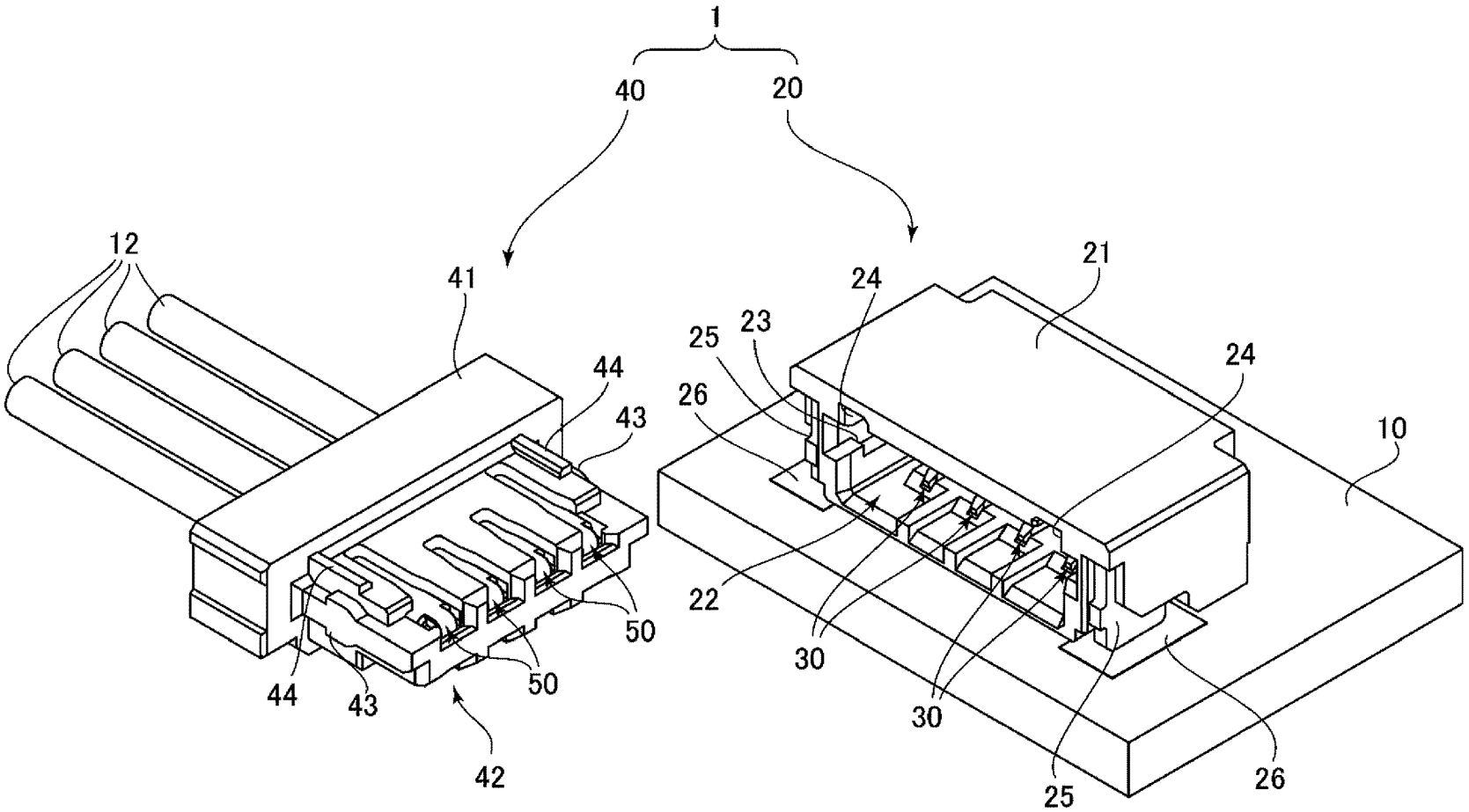
FIG. 1 illustrates a connector device according to an embodiment of the present invention.

An embodiment of the present invention is hereunder described with reference to the drawings. In all of the figures for describing the embodiment, in general, corresponding members are given the same reference numerals, and the same descriptions are not repeated.

FIG. 1 illustrates a connector device 1 according to an embodiment of the present invention. The connector device 1 includes a substrate-side connector (second connector) 20 and a cable-side connector (first connector) 40. The substrate-side connector 20 includes a receptacle housing 21, receptacle terminals 30, and reinforcing fittings 25. The receptacle housing 21 is mounted on a substrate 10 with a fitting direction in which the substrate-side connector 20 and the cable-side connector 40 are fitted to each other being substantially parallel to the substrate 10. The receptacle housing 21 is molded out of an insulating resin and includes a fitting recessed portion 22 that is formed so as to receive and so as to be fitted to a fitting protruding portion 42 of the cable-side connector 40. The fitting recessed portion 22 includes four inner walls as a result of being molded into a rectangular shape. However, the shape of the fitting recessed portion 22 is not limited thereto. The fitting recessed portion 22 may have any shape as long as the shape allows it to be fitted to the fitting protruding portion 42.

The inner walls of the fitting recessed portion 22 are formed such that at least a part of an elastic contact piece (see FIG. 3) of each receptacle terminal 30 is exposed from an inner wall on one side and at least a part of a fixed contact piece 32 (see FIG. 3) of each receptacle terminal 30 is exposed from an inner wall on another side. In the embodiment shown in FIG. 1 (and FIG. 3), each elastic contact piece 31 is exposed from the inner wall on a far side from the substrate 10 (an upper side), and each fixed contact piece 32 is exposed from the inner wall on a near side from the substrate 10 (a lower side).

Opposing inner walls on two sides of the inner wall where the elastic contact piece 31 (see FIG. 3) of each receptacle terminal 30 is exposed from the fitting recessed portion 22 and on two sides of the inner wall where the fixed contact piece 32 (see FIG. 3) of each receptacle terminal 30 is exposed from the fitting recessed portion 22 each have a receptacle engaging portion 23 that is formed in the form of a groove in the fitting direction of the connectors and that is formed so as to engage a corresponding plug engaging portion 43 of the fitting protruding portion 42. In the embodiment shown in FIG. 1, the receptacle engaging portions 23 are provided on the left and right inner walls that oppose each other on two sides of the upper inner wall and on two sides of the lower inner wall.

The form of each receptacle engaging portion 23 is not limited to the form of a groove, and may be in accordance with the form of each plug engaging portion 43. For example, each receptacle engaging portion 23 may be in the form of a ridge in the fitting direction of the connectors.

Guide portions 24 are formed in the form of a groove in one inner wall of the fitting recessed portion 22 so as to receive aligning portions 44 of the fitting protruding portion 42. The guide portions 24 are not limited to those having the form of a groove, and may have the form of a ridge. Although each guide portion 24 is provided in the upper inner wall of the fitting recessed portion 22, the position of each guide portion 24 is not limited thereto. Each guide portion 24 may be provided in an inner wall of the fitting recessed portion 22 in correspondence with the position of the fitting protruding portion 42.

In the embodiment shown in FIG. 1, four receptacle terminals 30 are placed side by side orthogonally to the fitting direction of the connectors and horizontally with respect to the substrate 10. However, the number of receptacle terminals 30 is not limited to four, and may be two or more.

The reinforcing fittings 25 for reinforcing the mounting of the substrate-side connector 20 on the substrate 10 are provided on corresponding side portions of the receptacle housing 21. The reinforcing fittings 25 are each provided on a corresponding one of two side portions that are situated in a direction orthogonal to the fitting direction of the connectors, and are mounted on corresponding mounting pads 26 on the substrate 10. If the substrate-side connector 20 is mounted on the substrate with sufficient strength, the reinforcing fittings 25 need not be provided.

The cable-side connector 40 includes a plug housing 41 and plug terminals 50, and is connected to cables 12. The plug housing 41 is molded out of an insulating resin and includes the fitting protruding portion 42 on a tip side in an extension direction of the cables 12. The fitting protruding portion 42, is formed so as to be inserted into and fitted to the fitting recessed portion 22 of the substrate-side connector 20. The fitting protruding portion 42 includes four outer walls as a result of being molded into a rectangular shape. However, the shape of the fitting protruding portion 42 is not limited thereto. The fitting protruding portion 42 may have any shape as long as the shape allows it to be fitted to the fitting recessed portion 22.

The outer walls of the fitting protruding portion 42 are formed such that a contact surface 51 (see FIG. 3) of each plug terminal 50 is exposed from an outer wall on one side, and a fitting portion 53 (see FIG. 3) of each plug terminal 50 is exposed from an outer wall on another side. In the embodiment shown in FIG. 1 (and FIG. 3), each contact surface 51 is exposed from the upper outer wall, and each fitting portion 53 is exposed from the lower outer wall.

The plug engaging portions 43 are provided on two side walls of the fitting protruding portion 42. Each plug engaging portion 43 is formed in the form of a ridge in the fitting direction of the connectors so as to engage the corresponding receptacle engaging portion 23 of the fitting recessed portion 22. In the embodiment shown in FIG. 1, the plug engaging portions 43 are provided not on the outer wall where the contact surface 51 (see FIG. 3) of each plug terminal 50 is exposed and the outer wall where the fitting portion 53 (see FIG. 3) of each plug terminal 50 is exposed, but are provided on the two outer walls (side walls), which are situated in a direction of arrangement of the four plug terminals 50 that are placed side by side orthogonally to the fitting direction of the connectors.

The plug engaging portions 43 are not limited to those having the form of a ridge, and may be formed in accordance with the form of the receptacle engaging portions 23. For example, the plug engaging portions 43 may be formed in the form of a groove in the fitting direction of the connectors.

Each aligning portion 44 is formed in the form of a ridge on an outer wall of the fitting protruding portion 42 in the fitting direction of the connectors, and is formed so as to receive the corresponding guide portion 24 of the fitting recessed portion 22. The aligning portions 44 are not limited to those having the form of a ridge, and may have the form of a groove. The aligning portions 44 are provided on the upper outer wall of the fitting protruding portion 42. However, the positions of the aligning portions 44 are not limited thereto, and may be on an outer wall of the fitting protruding portion 42 in correspondence with the position of the fitting recessed portion 22. By providing the aligning portions 44 that receive the corresponding guide portions 24, when the substrate-side connector 20 and the cable-side connector 40 are to be connected to each other, it is possible to align the connectors with each other and smoothly insert the fitting protruding portion 42 into the fitting recessed portion 22.

In the embodiment shown in FIG. 1, four plug terminals 50 are placed side by side orthogonally to the fitting direction of the connectors. However, the number of plug terminals 50 is not limited to four, and may be two or more. The substrate-side connector 20 is mounted on the substrate 10 with the fitting direction in which the substrate-side connector 20 is fitted to the cable-side connector 40 being parallel to the substrate 10. However, the mounting of the substrate-side connector 20 is not limited thereto. As in another embodiment described later and shown in FIGS. 10 to 12, the substrate-side connector 20 may be mounted on the substrate 10 perpendicularly to the substrate 10.

Figure 2:
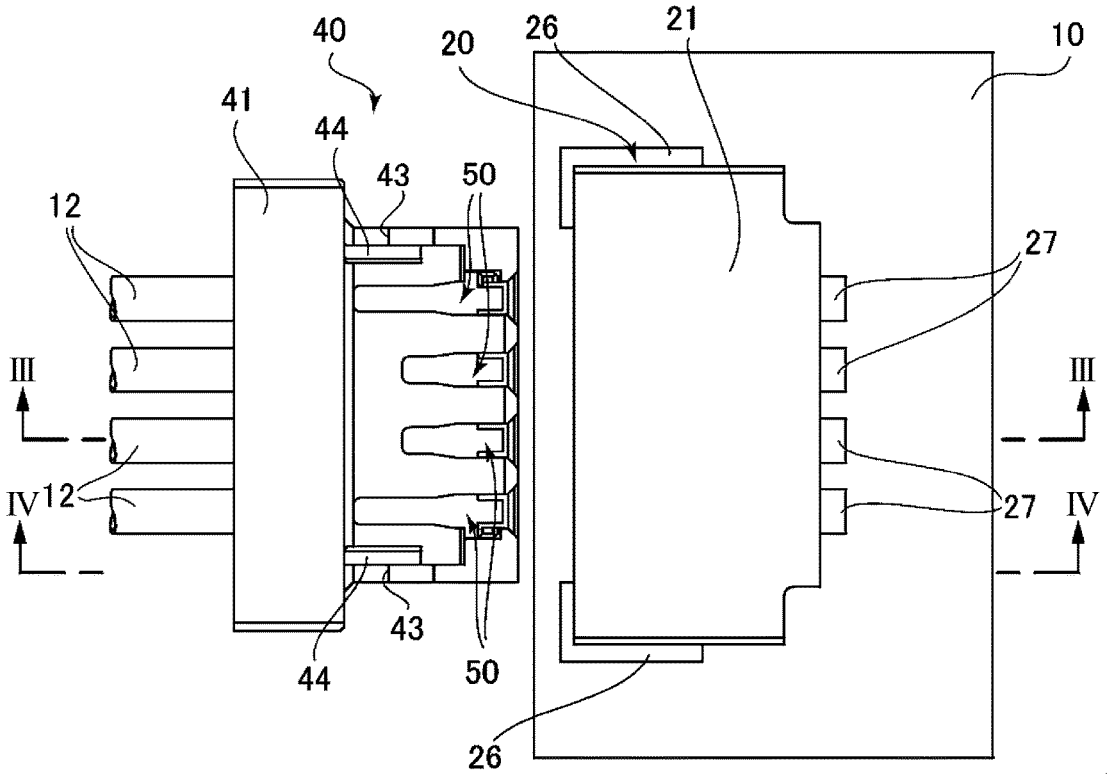
FIG. 2 is a top view of a state prior to connection of connectors of the connector device.
Figure 3:
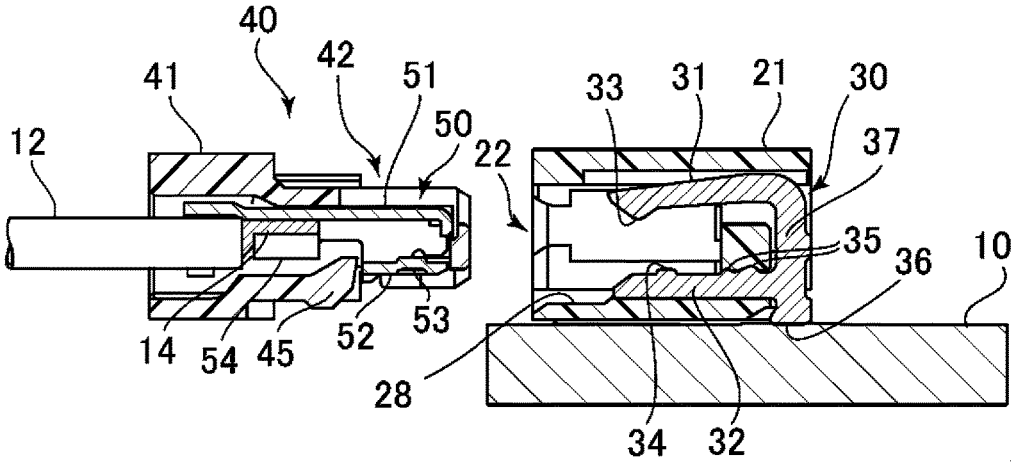
FIG. 3 is a sectional view of the connector device cut perpendicularly to a substrate along a straight line III-III in FIG. 2.
Figure 4:
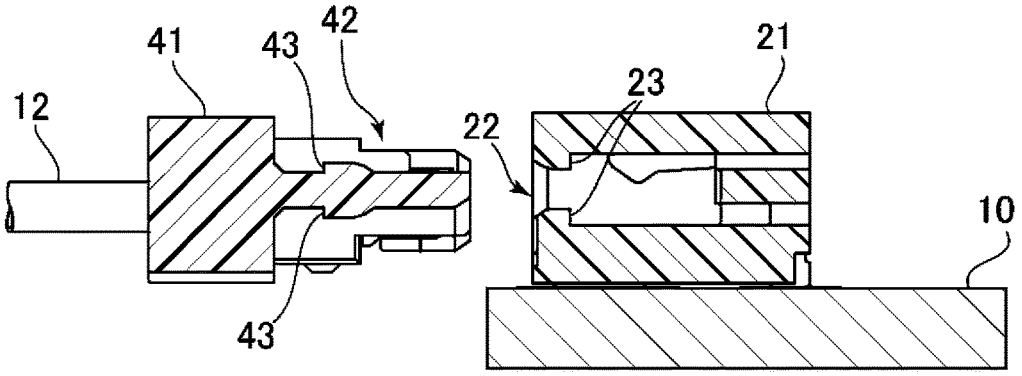
FIG. 4 is a sectional view of the connector device cut perpendicularly to the substrate along a straight line IV-IV in FIG. 2.

FIG. 2 is a top view of a state prior to the connection of the connectors of the connector device. In addition to the mounting pads 26 on which the reinforcing fittings 25 of the substrate-side connector 20 are mounted, mounting pads 27 are provided on the substrate 10. The mounting pads 27 are provided for mounting thereon mounting portions 36 (see FIG. 3) of the corresponding receptacle terminals 30 and for electrically connecting them. FIG. 3 is a sectional view of the connector device 1 cut perpendicularly to the substrate 10 along a straight line III-III. FIG. 4 is a sectional view of the connector device 1 cut perpendicularly to the substrate 10 along a straight line IV-IV.

As shown in FIG. 3, the elastic contact piece 31 of each receptacle terminal 30 does not contact the inner wall on the one side of the receptacle housing 21 (the upper side in FIG. 3), and is elastic. Each fixed contact piece 32 is in contact with and is supported by the inner wall on the other side of the receptacle housing 21 (the lower side in FIG. 3) so as not to spread outward. Each planar lance receiving portion 28 is provided on a portion of the lower inner wall of the receptacle housing 21 that does not contact the fixed contact piece 32, and receives a lance portion 45 of the corresponding plug housing 41. An end portion of each lance receiving portion 28 may be tapered.

Figure 8:
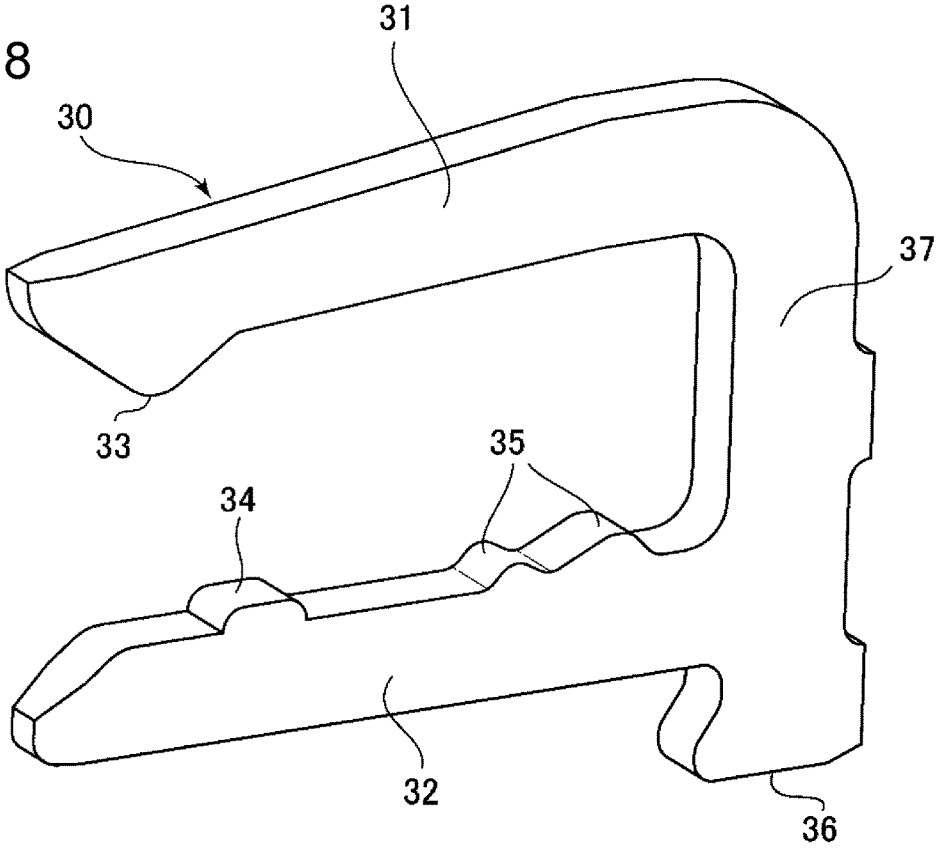
FIG. 8 is a perspective view of a receptacle terminal of a substrate-side connector.

Referring to, in addition to FIG. 3, the perspective view of a receptacle terminal shown in FIG. 8, each receptacle terminal 30 includes the elastic contact piece 31 and the fixed contact piece 32 with a base portion 37 interposed therebetween, and is U-shaped. Each elastic contact piece 31 is formed so as to be situated on the far side from the substrate 10 (the upper side), and each fixed contact piece 32 is formed so as to be situated on the near side from the substrate 10 (the lower side). In addition to the structures according to the embodiment shown in FIGS. 3 and 8, a structure in which each elastic contact piece 31 is formed so as to be situated on the near side from the substrate 10 (the lower side) and each fixed contact piece 32 is situated on the far side from the substrate 10 (the upper side) is possible. In such a structure in which the positions of each elastic contact piece 31 and each fixed contact piece 32 are reversed in the up-down direction, the structures of the inner walls of the receptacle housing 21 may also obviously be reversed in the up-down direction.

Each receptacle terminal 30 may be formed by punching a conductive metal. Each contact point portion 33 is provided on an end portion of its corresponding elastic contact piece 31. In the embodiment shown in FIGS. 3 and 8, each contact point portion 33 has a shape that protrudes towards an inner side of its corresponding U-shaped receptacle terminal 30 (that is, in a direction orthogonal to both the fitting direction and a terminal arrangement direction). However, the shape of each contact point portion 33 is not limited thereto, and may be any shape as long as the shape allows it to firmly contact and to be kept in electrical connection with the contact surface 51 of its corresponding plug terminal 50. Each receptacle terminal 30 may be press-fitted to a resin portion in the receptacle housing 21 by a press-fitting portion 35 and fixed thereto so as not to come off. In addition, each receptacle terminal 30 may be mounted on the corresponding mounting pad 27 by, for example, soldering by using the corresponding mounting portion 36 extending towards the substrate 10 from the base portion 37.

Each fit portion 34 and each press-fitting portion 35 are provided on an edge portion of the corresponding fixed contact piece 32 (that is, on an inner edge portion of the corresponding U-shaped receptacle terminal 30) opposing the corresponding elastic contact piece 31 such that each fit portion 34 is provided at a front-end-side position of the edge portion substantially facing (obliquely facing) the corresponding contact point portion 33, and such that each press-fitting portion 35 is provided at a rear-end side position of the edge portion. In the embodiment shown in FIG. 3 and FIG. 8, each fit portion 34 has the form of a protruding portion that protrudes towards the inner side of the corresponding U-shaped receptacle terminal 30. However, the form of each fit portion 34 is not limited thereto. Each fit portion 34 may have any form such as the form of a recessed portion as along as the form allows it to be fitted to the fitting portion 53 of the corresponding plug terminal 50 and the fitted state between the connectors to be maintained.

As shown in FIG. 3, the contact surface 51 of each plug terminal 50 is exposed from the one side of the fitting protruding portion 42. Each contact surface 51 is a comparatively rigid (non-elastic) surface that is formed so as to contact the contact point portion 33 of the elastic contact piece 31 of the corresponding receptacle terminal 30. Each elastic surface 52, which is the other contact surface, is exposed from the other side of the fitting protruding portion 42 (the lower side in FIG. 3) and includes the corresponding fitting portion 53 at the exposed surface. Each fitting portion 53 is formed so as to be fitted to and so as to contact the fit portion 34 of the fixed contact piece 32 of the corresponding receptacle terminal 30.

In the embodiment shown in FIG. 3, each fit portion 34 is formed as a protruding portion, and each fitting portion 53 is formed as a recessed portion. However, the form of each fit portion 34 and the form of each fitting portion 53 are not limited thereto. Each fit portion 34 may be formed as a recessed portion, and each fitting portion 53 may be formed as a protruding portion. Alternatively, each fit portion 34 and each fitting portion 53 may have any form as along as the form opposes a coming-off force in a coming-off direction (that is, a direction along the fitting direction in which the cable-side connector 40 comes off from the substrate-side connector 20; left direction in FIGS. 2 to 7) when each fit portion 34 is fitted to its corresponding fitting portion 53. In the embodiment shown in FIG. 3, the plug housing 41 includes four plug terminals 50, the receptacle housing 21 includes four receptacle terminals 30, all of the plug terminals 50 each include the corresponding fitting portion 53, and all of the receptacle terminals each include the corresponding fit portion 34. However, the present invention is not limited to this embodiment. Not all plug terminals 50 are required to include the fitting portion 53. It is possible for at least one of the two or more plug terminals 50 to include the fitting portion 53, and the receptacle terminal 30 that is connected to the plug terminal 50 including the fitting portion 53 to include the fit portion 34.

Figure 9:
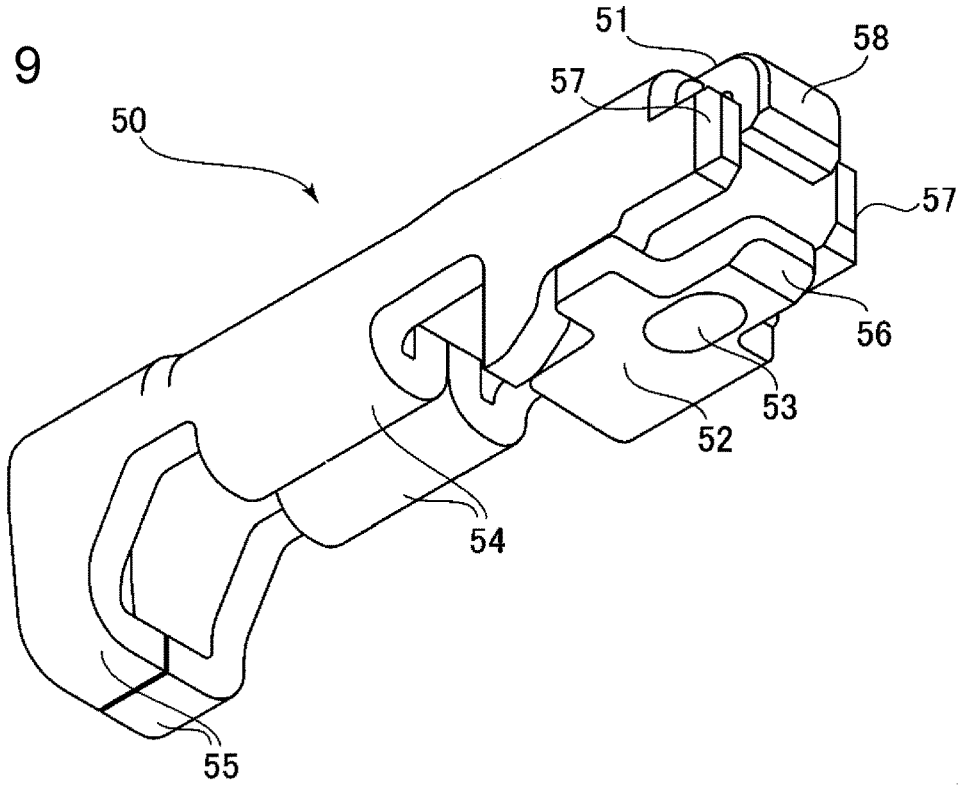
FIG. 9 is a perspective view of a plug terminal of a cable-side connector.

Each plug terminal 50 includes a core crimping portion 54 and a covering crimping portion 55 for connection to the cables 12 (see FIG. 9). By crimping each core crimping portion 54 with a core wire 14 of the corresponding cable 12, it is possible to press-fit each core wire 14 and the corresponding plug terminal 50 and electrically connect them to each other. In addition, by crimping each covering crimping portion 55 (see FIG. 9), which is a rear-end portion of the corresponding plug terminal 50, with a covering of the corresponding cable 12, it is possible to prevent the plug terminals 50 from coming off from the cables 12.

The plug housing 41 includes the lance portions 45 that are formed on a side where the elastic surfaces 52 and the fitting portions 53 of the plug terminals 50 are exposed (the lower side in FIG. 3) and that extend in a front-end direction from corresponding rear-end portions. A front end of each lance portion 45 is positioned at the inner side of the corresponding plug terminal 50 between the contact surface 51 and the elastic surface 52, and extends up to a position near a rear-end-side edge portion of the elastic surface 52. One or more of the lance portions 45 may be provided in accordance with the number of plug terminals 50.

Referring to, in addition to FIG. 3, the perspective view of a plug terminal shown in FIG. 9, each plug terminal 50 includes the comparatively rigid contact surface 51 on the one side (the upper side in FIG. 3) and the fitting portion 53 at the elastic surface 52 on the other side (the lower side in FIG. 3). Each plug terminal 50 may be formed by punching a conductive metal and bending the punched metal that is in the form of a plate into a cylindrical shape (rod shape). Each elastic surface 52 is formed by bending a portion of the corresponding plug terminal 50 extending from one side wall on a front-end side of the corresponding plug terminal 50, and is elastic. A tapering portion 56 for facilitating a fitting operation with respect to the corresponding receptacle terminal 30 may be provided at a front-end-side edge portion of the corresponding elastic surface 52. Similarly, a tapering portion 57 may also be provided on a front-end-side end portion of a side wall. It is possible to form each front end portion 58 by bending a portion extending from a front-end-side end portion of the corresponding contact surface 51, and smoothly contact each front end portion 58 with the contact point portion 33 of the corresponding receptacle terminal 30.

As shown in FIG. 4, the receptacle housing 21 includes the receptacle engaging portions 23 formed by forming the corresponding inner walls in the form of a groove in the fitting direction. It is possible to form the receptacle engaging portions 23 in the form of a groove in the fitting direction in two inner walls in the fitting recessed portion 22 where the elastic contact pieces 31 and the fixed contact pieces 32 are not exposed (that is, the two inner walls that are perpendicular to the substrate 10 in FIG. 3). The plug housing 41 includes the plug engaging portions 43 that are formed by forming the side walls in the form of a ridge in the fitting direction. It is possible to form the plug engaging portions 43 on the two side walls of the fitting protruding portion 42 where the contact surfaces 51 and the elastic surfaces 52 (the fitting portions 53) are not exposed. That is, the plug engaging portions 43 are provided on the two side surfaces with a portion where the contact surface 51 and the fitting portion 53 of each plug terminal 50 are exposed from the fitting protruding portion 42 being interposed therebetween.

The receptacle engaging portions 23 are formed such that the widths of the grooves at an opening of the fitting recessed portion 22 are small so as to allow engagement with the plug engaging portions 43. The plug engaging portions 43 are formed such that the widths of intermediate portions of the ridges are large so as to allow engagement with the receptacle engaging portions 23.

Figure 5:
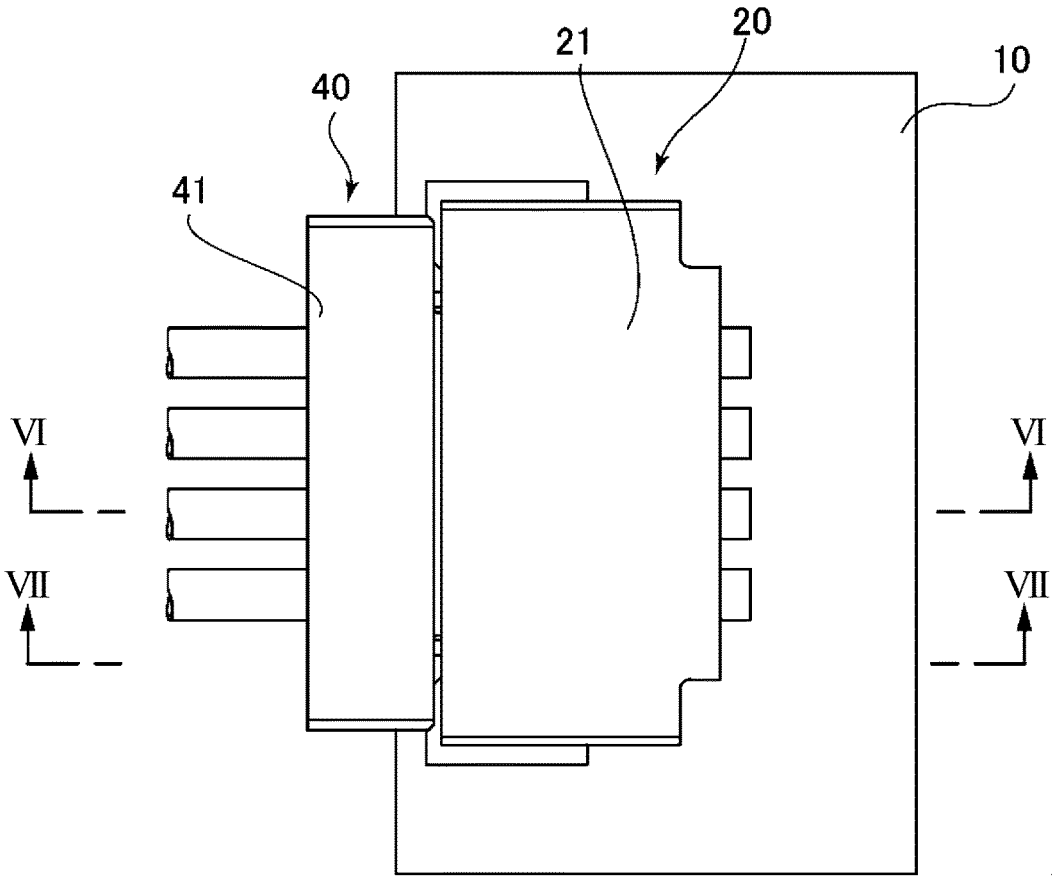
FIG. 5 is a top view of a state after the connection of the connectors of the connector device.
Figure 6:
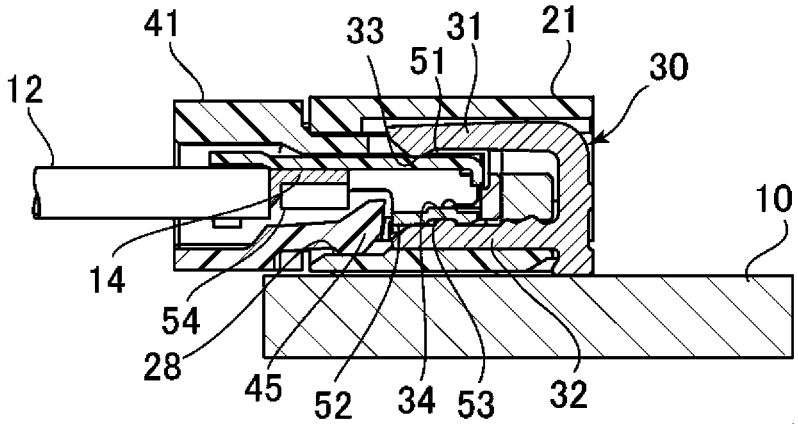
FIG. 6 is a sectional view of the connector device cut perpendicularly to the substrate along a straight line VI-VI in FIG. 5.
Figure 7:
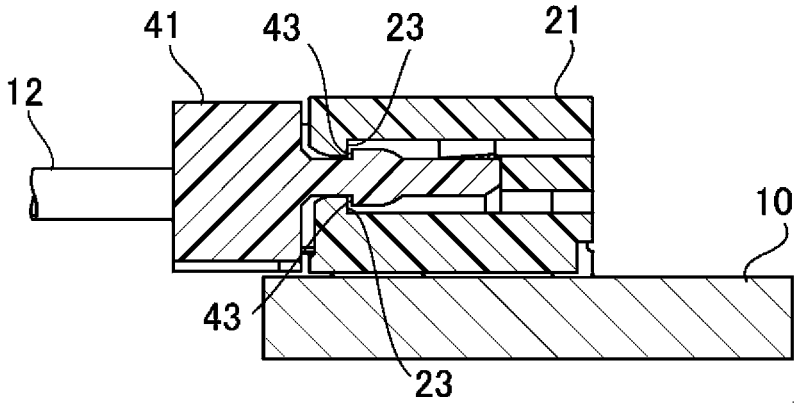
FIG. 7 is a sectional view of the connector device cut perpendicularly to the substrate along a straight line VII-VII in FIG. 5.

FIG. 5 is a top view of a state after the connection of the connectors of the connector device. FIGS. 6 and 7 are each a sectional view of a state in which the fitting protruding portion 42 of the plug housing 41 is fitted to the fitting recessed portion 22 of the receptacle housing 21. More specifically, FIG. 6 is a sectional view of the connector device 1 cut perpendicularly to the substrate 10 along a straight line VI-VI. FIG. 7 is a sectional view of the connector device 1 cut perpendicularly to the substrate 10 along a straight line VII-VII.

As shown in the sectional view of FIG. 6, a part of the plug terminal 50 is disposed between the elastic contact piece 31 and the fixed contact piece 32 of the receptacle terminal 30, and, by causing the contact point portion 33 of the elastic contact piece 31 to push the contact surface 51 on the one side of the plug terminal 50 towards the fixed contact piece 32 by an elastic force, the fitting portion 53 on the other side is pushed against the fit portion 34 of the fixed contact piece 32. By virtue of such a structure, since each fitting portion 53 is firmly fitted to the corresponding fit portion 34, even if a force that is produced by, for example, vibration is exerted upon, for example, the substrate-side connector, the cable-side connector, and the cables, it is possible to maintain the fitted state between the connectors and to prevent the connectors from coming off from each other.

In particular, as in the embodiment, in the connector device 1 including the plurality of receptacle terminals 30 and the plurality of plug terminals 50, it is possible to increase a coming-off force in accordance with the number of terminals 30 and the number of terminals 50, and to increase coming-off forces at a plurality of locations where the terminals 30 and the terminals 50 are disposed in the terminal arrangement direction. Therefore, for example, when a coming-off force is exerted upon the cable-side connector 40 in the fitting direction, the plurality of terminals 30 and 50 can uniformly oppose the coming-off force; and when the coming-off force is exerted obliquely to the fitting direction, the plurality of terminals 30 and 50 can oppose the coming-off force without excessive force being exerted upon only particular terminals 30 and 50 at particular locations.

Since the lance portions 45 of the plug housing 41 are elastic, when the lance portions 45 come into contact with the corresponding lance receiving portions 28 of the receptacle housing 21, the lance portions 45 are deformed and the front ends of the lance portions 45 that are positioned on the inner side of the corresponding plug terminals 50 between the contact surfaces 51 and the corresponding elastic surfaces 52 prior to the connection of the connectors of the connector device 1 move more towards the inner side of the corresponding plug terminals 50 (towards the side of the corresponding contact surfaces 51). That is, in the embodiment shown in FIG. 6, the deformation of the lance portions 45 causes the front ends thereof to move above the corresponding elastic surfaces 52. Therefore, even if, after the connection of the connectors of the connector device 1, for example, the cables 12 are strongly pulled and a force that tries to shift the plug terminals 50 themselves press-contacted and connected to the corresponding cables 12 by the core crimping portions 54 and the covering crimping portions 55 is produced, rear-end-side-edge portions of the contact surfaces 51 of the plug terminals 50 strike the front-end portions of the corresponding lance portions 45 of the plug housing 41. Therefore, it is possible to prevent the plug terminals 50 themselves from coming off from the plug housing 41.

As shown in the sectional view of FIG. 7, a part of each plug terminal 50 is such that, when the connectors of the connector device 1 are connected, a large-width portion of the ridge of each plug engaging portion 43 moves beyond a small-width portion of the groove of each receptacle engaging portion 23, and each plug engaging portion 43 and its corresponding receptacle engaging portion 23 engage each other, so that it is possible to prevent the plug housing 41 from coming off from the receptacle housing 21.

In the embodiment, in addition to increasing coming-off forces produced by the receptacle terminals 30 and the plug terminals 50, a coming-off force can be further increased by increasing coming-off forces produced by the receptacle housing 21 and the plug housing 41. In particular, by including different properties and structures in one connector device as with a connector device including metal terminals and resin housings, it is possible to increase the coming-off force under various conditions.

Figure 10:
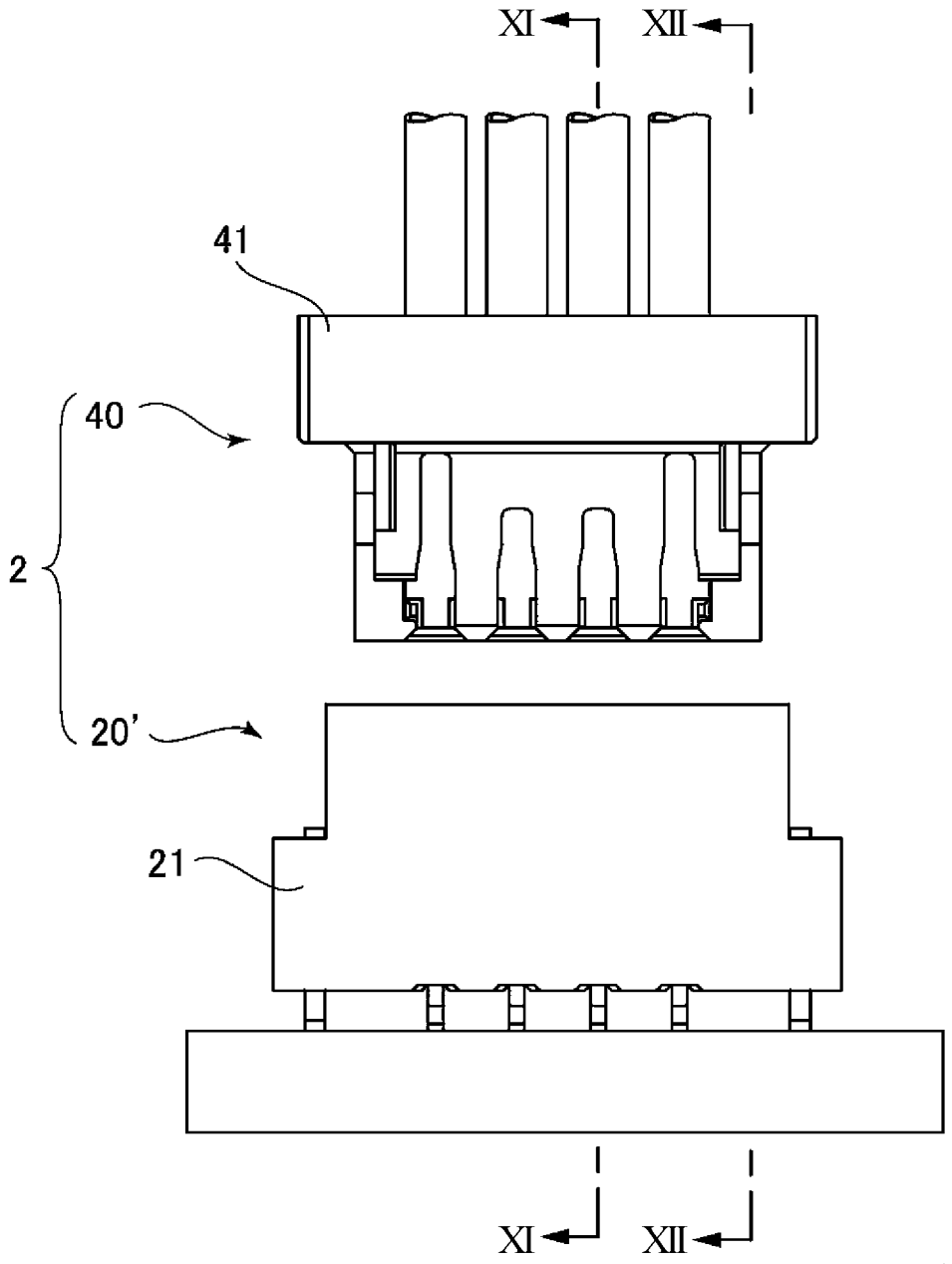
FIG. 10 illustrates a state prior to connection of connectors of a connector device according to another embodiment of the present invention.
Figure 11:
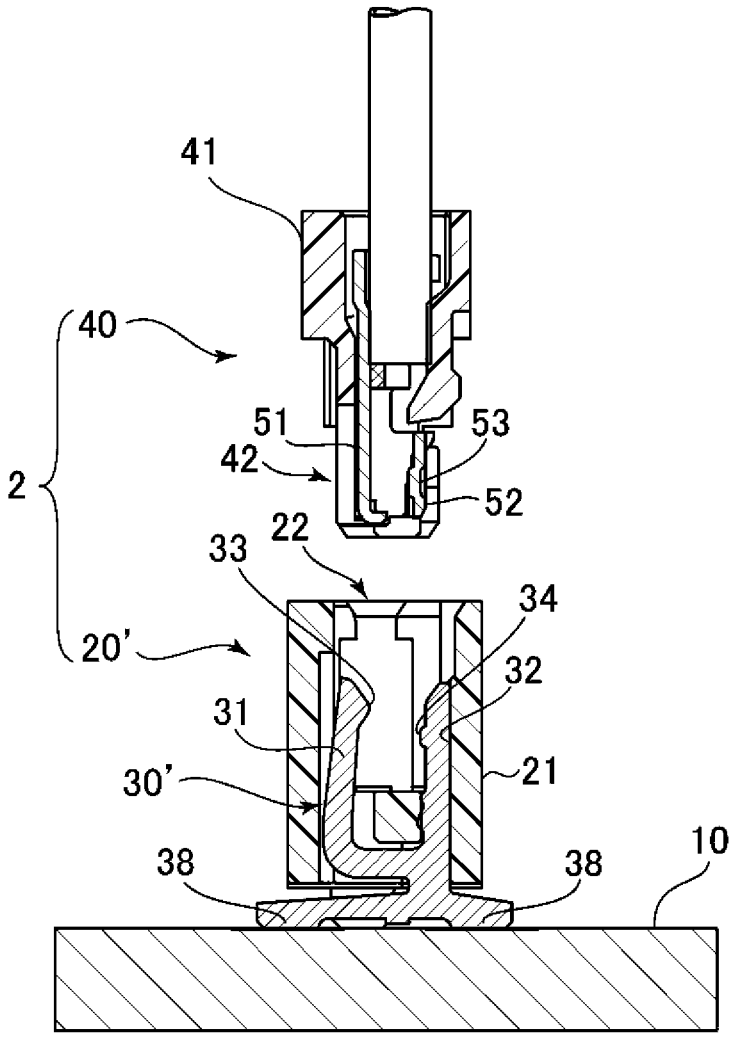
FIG. 11 is a sectional view of the connector device cut perpendicularly to a substrate along a straight line XI-XI in FIG. 10.
Figure 12:
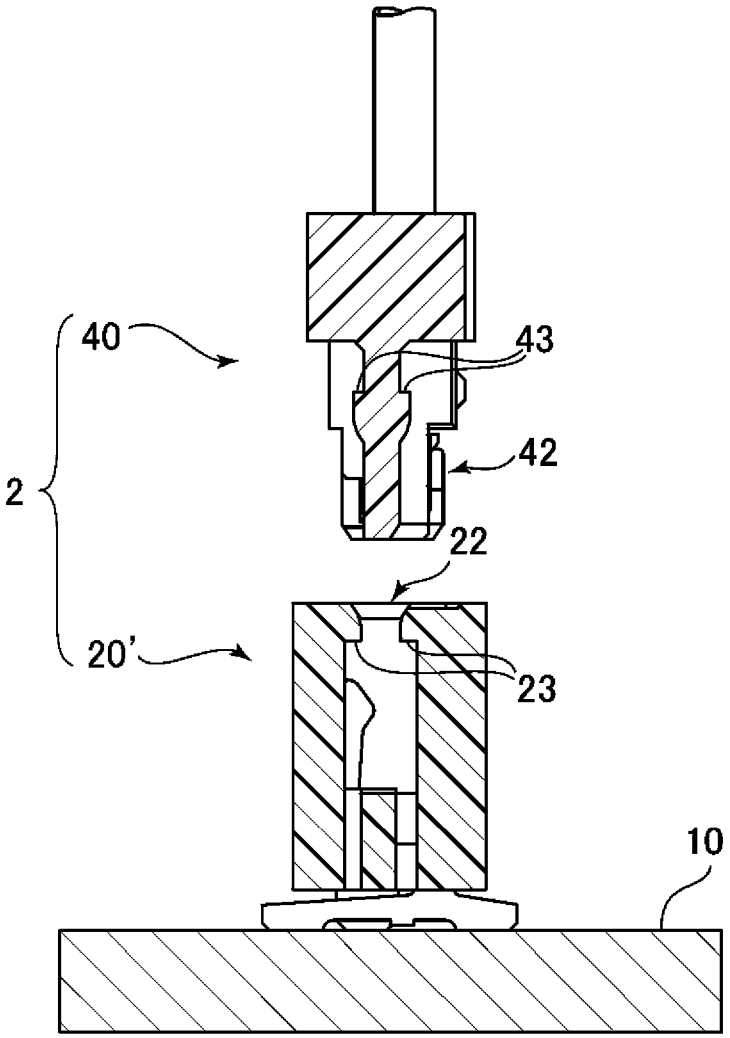
FIG. 12 is a sectional view of the connector device cut perpendicularly to the substrate along a straight line XII-XII in FIG. 10.

FIG. 10 illustrates a state prior to connection of connectors of a connector device 2 according to another embodiment of the present invention. The connector device 2 includes a substrate-side connector 20' and a cable-side connector 40. The substrate-side connector 20' is formed such that a fitting recessed portion 22 of a receptacle housing 21 faces upward with respect to a substrate 10. FIG. 11 is a sectional view of the connector device 2 cut perpendicularly to the substrate 10 along a straight line XI-XI. FIG. 12 is a sectional view of the connector device 2 cut perpendicularly to the substrate 10 along a straight line XII-XII.

As shown in FIGS. 11 and 12, the structure of the cable-side connector 40 is the same as that according to the previously described embodiment (see, for example, FIGS. 1 to 7). As shown in FIG. 11, the substrate-side connector 20' is such that the form of a mounting portion 38 of a receptacle terminal 30' differs from the form of the mounting portion 36 of each receptacle terminal 30 according to the previously described embodiment (see, for example, FIGS. 3, 6, and 8). The receptacle terminal 30' of the substrate-side connector 20' includes the mounting portion 38 that is formed such that an elastic contact piece 31 and a fixed contact piece 32 face perpendicularly to the substrate 10. The receptacle 30' can be mounted on a mounting pad (not shown) by, for example, soldering by using the mounting portion 38 that extends towards the substrate 10 from the fixed contact piece 32 and that spreads horizontally along the substrate 10. The other structural features of the substrate-side connector 20' are the same as those according to the previously described embodiment (see, for example, FIGS. 1 to 7).

The individual embodiments according to the present invention may be combined and implemented as appropriate.

The connector device according to the present invention can be used in, for example, transmitting electrical signals between substrates in an electronic device.

What is claimed is:

1. A connector device comprising:

a first connector that includes at least a plug terminal and a plug housing that supports the plug terminal, the first connector being connected to a cable; and a second connector that includes at least a receptacle terminal and a receptacle housing that supports the receptacle terminal, the second connector being mounted on a substrate, wherein the plug terminal includes a contact surface on one side and a fitting portion on another side, wherein the receptacle terminal includes an elastic contact piece on one side and a fixed contact piece on another side, the elastic contact piece including a contact point portion, the fixed contact piece including a fit portion, wherein when the first connector and the second connector are connected to each other, a part of the plug terminal is disposed between the elastic contact piece and the fixed contact piece of the receptacle terminal and an elastic force that is produced by the elastic contact piece of the receptacle terminal causes the contact surface of the plug terminal to be pushed by the contact point portion of the receptacle terminal, and wherein the fitting portion of the plug terminal is formed so as to be fitted to the fit portion of the receptacle terminal.

2. The connector device according to claim 1, wherein the fixed contact piece is formed so as to contact an inner wall of the receptacle housing and so as not to spread outward.

3. The connector device according to claim 1, wherein the plug housing includes a fitting protruding portion where the contact surface of the plug terminal is exposed from the one side and where the fitting portion of the plug terminal is exposed from the other side, wherein the receptacle housing includes a fitting recessed portion that is formed so as to receive and so as to be fitted to the fitting protruding portion, and wherein at least a part of the elastic contact piece of the receptacle terminal is exposed from one of inner walls of the fitting recessed portion and at least a part of the fixed contact piece is exposed from another of the inner walls opposing the one of the inner walls.

4. The connector device according to claim 1, wherein the number of the plug terminals of the plug housing is two or more, wherein at least one of the two or more plug terminals includes the fitting portion, wherein the number of the receptacle terminals of the receptacle housing is equal to the number of the plug terminals, and wherein the receptacle terminal that is connected to the plug terminal including the fitting portion includes the fit portion.

5. The connector device according to claim 1, wherein the fitting portion has a form of a recess, and the fit portion has a form of a protrusion.

6. The connector device according to claim 1, wherein the fitting portion has a form of a protrusion, and the fit portion has a form of a recess.

7. The connector device according to claim 1, wherein the plug housing includes four of the plug terminals and the receptacle housing includes four of the receptacle terminals, and wherein all of the plug terminals each include the fitting portion and all of the receptacle terminals each include the fit portion.

8. The connector device according to claim 1, wherein the plug housing includes a plug engaging portion at the fitting protruding portion, wherein the receptacle housing includes a receptacle engaging portion at an inner wall of the fitting recessed portion, and wherein the plug engaging portion is formed so as to engage with the receptacle engaging portion when the fitting protruding portion is inserted into the fitting recessed portion.

9. The connector device according to claim 8, wherein a plurality of the plug engaging portions are each provided at a corresponding one of two side portions with a portion where the contact surface and the fitting portion of the plug terminal are exposed from the fitting protruding portion interposed therebetween, and wherein a plurality of the receptacle engaging portions are each provided at a corresponding one of opposing inner walls with an inner wall where the elastic contact piece of the receptacle terminal is exposed from the fitting recessed portion and an inner wall where the fixed contact piece of the receptacle terminal is exposed from the engaging recessed portion interposed therebetween.

10. The connector device according to claim 1, wherein the second connector is mounted on the substrate with a fitting direction in which the second connector is fitted to the first connector being parallel to the substrate.

11. The connector device according to claim 10, wherein the receptacle terminal includes in a U-shape the elastic contact piece and the fixed contact piece with a base portion interposed therebetween, and wherein the elastic contact piece is situated on an upper side that is a far side from the substrate, and the fixed contact piece is situated on a lower side that is a near side from the substrate.

12. The connector device according to claim 10, wherein the receptacle terminal includes in a U shape the elastic contact piece and the fixed contact piece with a base portion interposed therebetween, and wherein the elastic contact piece is situated on a lower side that is a near side from the substrate, and the fixed contact piece is situated on an upper side that is a far side from the substrate.

13. The connector according to claim 1, wherein the second connector is mounted on the substrate with a fitting direction in which the second connector is fitted to the first connector being perpendicular to the substrate.

* * * * *